US005702063A

United States Patent [19]

Bottari

[11] Patent Number: 5,702,063

[45] Date of Patent: Dec. 30, 1997

[54] YARN SUPPORT WITH MEANS FOR ANCHORING A YARN END

[75] Inventor: Marco Bottari, Prato, Italy

[73] Assignee: Mariplast S.p.A., Prato, Italy

[21] Appl. No.: 648,567

[22] Filed: May 16, 1996

[30] Foreign Application Priority Data

May 19, 1995 [IT] Italy ..... FI95A0110

[51] Int. Cl.[6] ..... B65H 75/28; B65H 55/00

[52] U.S. Cl. ..... 242/125.2; 242/125.1; 242/172

[58] Field of Search ..... 242/125, 125.1, 242/125.2, 125.3, 172

[56] References Cited

U.S. PATENT DOCUMENTS

| | | | |
|---|---|---|---|
| 3,283,489 | 11/1966 | Bakker | 242/125.1 X |
| 3,358,943 | 12/1967 | Pelson | 242/125.2 |
| 3,625,451 | 12/1971 | Anderson | 242/125.1 |
| 3,955,775 | 5/1976 | Egyptien et al. | 242/125.1 |
| 4,258,843 | 3/1981 | Wymer | 242/125.1 X |
| 4,852,823 | 8/1989 | Adams et al. | 242/125.1 |

*Primary Examiner*—Michael Mansen
*Attorney, Agent, or Firm*—McGlew and Tuttle

[57] ABSTRACT

It is necessary for yarn which is wound into packages on supports or centers and is intended to be dyed, or at any rate subsequently employed for other uses, to be able to form, on an annular zone at the sides of the support a number of turns of "reserve" yarn available and intended for joining to the yarn of a subsequent package. In order to fasten the yarn end, a guide notch is formed in the edge of the annular zone and is combined with a portion of very little thickness which can be torn by the yarn which is inserted and forced into the notch such that it becomes wedged in the tear and is held therein. This anchoring device may be provided in either the base or the top of the center, or in both the base and the top of the center, in order to fasten both ends of the wound yarn.

8 Claims, 1 Drawing Sheet

YARN SUPPORT WITH MEANS FOR ANCHORING A YARN END

FIELD AND BACKGROUND OF THE INVENTION

It is well known that supports (cylindrical, conical or frustoconical centers) on which yarn is wound to form packages intended to undergo subsequent processes—dyeing, warping, weaving or other uses—are usually provided with an annular zone on one or both sides of the support. This annular zone is used to wind a number of turns of "reserve" yarn available and intended for joining to the yarn of a subsequent package. Currently, the reserve yarn end is fastened somewhat precariously using random means which are rather impractical and unreliable.

SUMMARY AND OBJECTS OF THE INVENTION

It is an object of the present invention to solve the above problem in an extremely satisfactory way.

For this purpose, the support comprises—in one embodiment an annular zone, with a guide notch beginning in an edge and combined with a diaphragm portion of very little thickness. The diaphragm can be torn by the yarn which is inserted and forced into said notch and into said portion of very little thickness.

Said portion of very little thickness can be formed approximately transversely to said guide notch, and preferably extends out on either side of said guide notch. However, it would also be possible for the zone of very little thickness to be orientated in a different way, as long as it begins in the base of said notch.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENT

Figure 1:
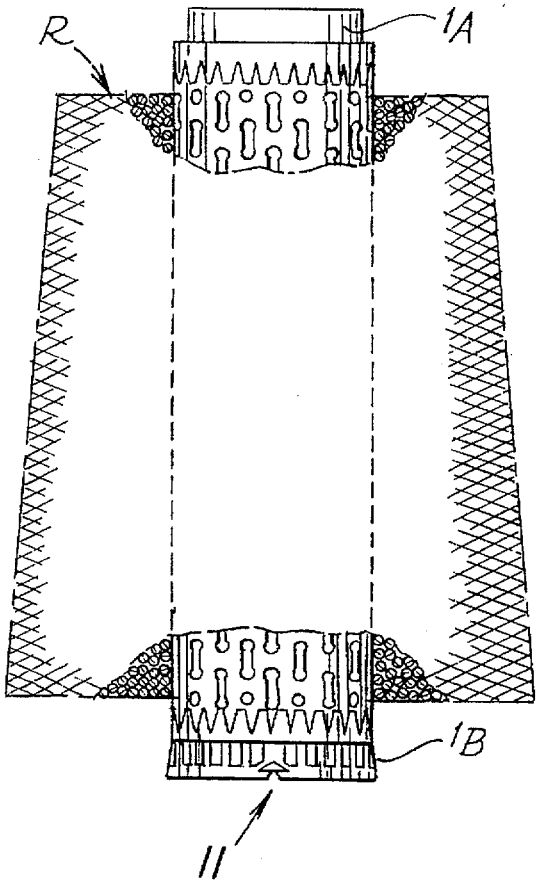
FIG. 1 shows a very general view of a non-stackable center or support for yarn packages.
Figure 4:
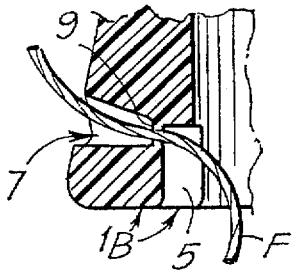
FIGS. 4 and 5 show the same detail in a sectional view on IV—IV in FIG. 2 and in a view similar to the one in FIG. 3 once the yarn has been inserted and is held in the tear formed by it.

In the drawings, the center or support, has a body which is indicated as a whole by the reference numeral and in FIG. 1, has two ends 1A and 1B. On one or both of the ends may be formed a reserve of a number of turns of yarn, which represent the beginning of the yarn package, indicated as a whole by the letter R in FIG. 1. It must be possible to grip the beginning of this reserve yarn, or in any case the end of the yarn of the package R, by some suitable means in order to prevent said yarn end from coming undone, which is very easily done in the case of turns of reserve yarn which are exposed since they are wound separately on the end of the center. In order to grip the yarn end, a holding means is provided along the terminal edge of the end of the center, as illustrated in particular in FIGS. 2 to 6, which show a detail of the end 1B.

For this purpose a transverse notch 3 is made, beginning in the terminal edge of the end 1B, preferably in the region of a shallow recess 5 formed on the inside of said edge. Next to said notch 3, on the outside of the edge, there is a deep recess 7 which in the drawing has a triangular shape when viewed head-on and whose bottom edge may slope toward the notch 3 and communicates with the tip of said notch. Formed at the inside end of the notch 3 and at the base of the recess 7 is a thin diaphragm holding portion 9 whose thickness is locally very reduced. The thin diaphragm can be obtained easily by means of a molding process, by accurately molding those surfaces which will face each other to create this thin diaphragm 9. The diaphragm 9 is formed transversely and symmetrically with respect to the notch 3, as may be clearly seen in particular in FIG. 3. However, it may have a different shape and/or orientation, depending on the molding process chosen. In all cases, however, this thin diaphragm 9 must be located at the tip of the notch 3. The diaphragm 9 is formed from the same thermoplastic material which is used to injection-mold the center, and must be thin enough that it can be torn by forcing the yarn against it.

Figure 5:
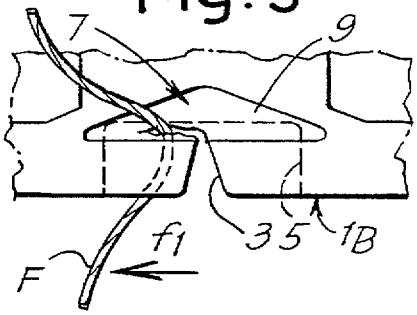
Figure 6:
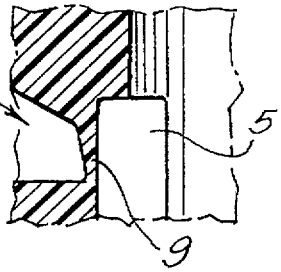
FIG. 6 shows an enlarged detail from FIG. 4, before the tear is made.
Figure 3:
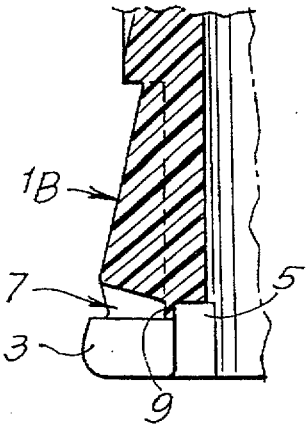
FIG. 3 shows a section on the line III—III in FIG. 2.
Figure 2:
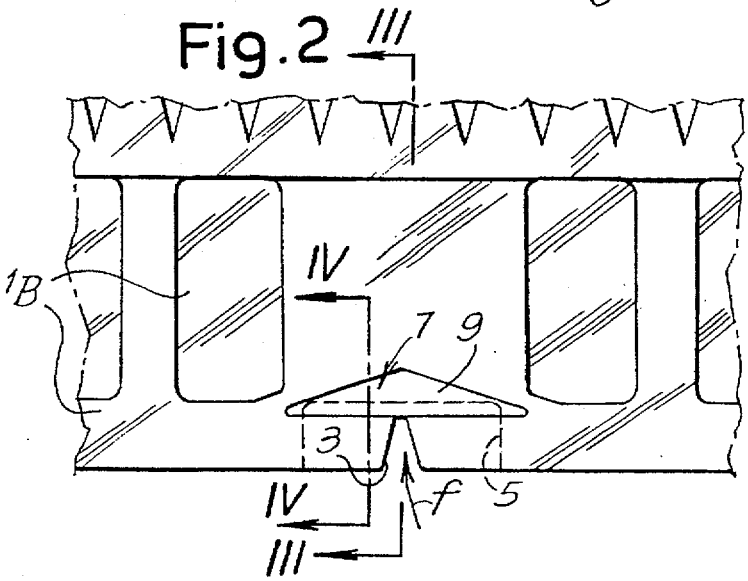
FIG. 2 shows an enlarged detail of the zone indicated by the arrow II in FIG. 1.

With this arrangement, the end of the yarn of the package, or rather the end of the reserve turns wound on the end 1B of the center, is inserted in the direction of the arrow f in FIG. 2 and then forced—holding it on both the inside and the outside—against the diaphragm 9, which is torn as a result of the forcing action, for example in the direction of the arrow f1 in FIG. 5, on one or other side of the diaphragm 9 starting from the tip of the notch 3. The tearing action produces two lips in the diaphragm 9 which can be seen in FIGS. 4 and 5. These lips are able to grip the yarn F securely enough between themselves to prevent the terminal turns of reserve yarn from coming undone or even to prevent the package from beginning to come undone.

This means is produced using a simple molding operation to mold the center.

It should be understood that the drawing shows only one example of the invention, given solely by way of practical demonstration, it being possible to vary the forms and arrangements thereof without thereby departing from the scope of the concept underlying said invention.

I claim:

1. A yarn support comprising:

a yarn support body made from molded the thermoplastic resin on which yarn is wound into packages, said yarn support body having an edge defining a guide notch, said yarn support body having a lateral annular zone on which a number of turns of "reserve" yarn are wound;

a diaphragm connected to said yarn support body, said diaphragm having an edge extending across said guide notch, said diaphragm having holding means formed of a material and having a thickness for causing said diaphragm to be torn by a yarn inserted into said guide notch and forced against said diaphragm.

2. A yarn support in accordance with claim 1, wherein:

a tear is provided formed in said diaphragm for holding the yarn.

3. A yarn support in accordance with claim 1, wherein:

said diaphragm is formed approximately transversely to said guide notch.

4. A yarn support in accordance with claim 1, wherein:

said diaphragm extends outward from guide notch.

5. A yarn support in accordance with claim 1, wherein:

said body includes another edge with another guide notch and with another diaphragm, said another diaphragm having a holding means, said diaphragm holding a head end of the yarn, said another diaphragm holding a tail end of the yarn.

6. A yarn support in accordance with claim 1, wherein:

a thickness of said diaphragm is thinner than a thickness of said body.

7. A yarn support comprising:

a yarn support body with an edge, said edge defining a guide notch;

a holding portion connected to said yarn support body, said holding portion having a thickness less than a thickness of an area of said yarn support body to which said holding portion is connected, said holding portion having an edge extending across said guide notch, said holding portion having means for having a tear in said holding portion holding the yarn.

8. A method for holding yarn on a support, the method comprising the steps of:

providing a body with an edge defining a guide notch, said body including a diaphragm positioned in contact with said guide notch;

inserting a yarn into said guide notch;

forcing the yarn against said diaphragm to cause said diaphragm to be torn;

inserting the yarn into a tear in said diaphragm to hold the yarn in said diaphragm.

* * * * *